US005470128A

United States Patent [19]

Kerkham

[11] Patent Number: 5,470,128

[45] Date of Patent: Nov. 28, 1995

[54] ARTICLE OF FURNITURE

[75] Inventor: Katrina A. Kerkham, Wentworth Falls, Australia

[73] Assignee: Sebel Furniture Limited, Bankstown, Australia

[21] Appl. No.: 373,507

[22] Filed: Jan. 17, 1995

Related U.S. Application Data

[63] Continuation of Ser. No. 146,314, Nov. 2, 1993, abandoned.

[30] Foreign Application Priority Data

Nov. 2, 1992 [AU] Australia ..... PL5617

[51] Int. Cl.[6] ..... A47C 15/00

[52] U.S. Cl. ..... 297/232; 297/248; 297/172; 297/440.14

[58] Field of Search ..... 297/172, 248, 297/232, 249, 257, 440.1, 440.14

[56] References Cited

U.S. PATENT DOCUMENTS

| | | | |
|---|---|---|---|
| 3,261,640 | 7/1966 | Straits | 297/248 X |
| 3,885,766 | 5/1975 | Resch et al. | 297/232 X |
| 4,498,649 | 2/1985 | Toll | 297/232 X |
| 4,630,864 | 12/1986 | Toll | 297/232 |
| 4,632,452 | 12/1986 | Vogel | 297/232 |
| 4,662,679 | 5/1987 | Franck et al. | 297/249 X |
| 5,292,177 | 3/1994 | Balderi et al. | 297/232 |

FOREIGN PATENT DOCUMENTS

92/00944 5/1992 WIPO .

OTHER PUBLICATIONS

Copy of Search Report from Corresponding British Application No. 9322532.4.

*Primary Examiner*—Laurie K. Cranmer

*Attorney, Agent, or Firm*—Merchant, Gould, Smith, Edell, Welter & Schmidt

[57] ABSTRACT

An arrangement of linking modular furniture is disclosed. There is a spine (10) supported by-spaced apart stands (6). On each spine are located a number of seat frames (12). The seat frames are supported by at least one arm (18,20) and preferably by arm rests (26) which together with the arms (18,20) form a truss. A table (30) is also provided. A large number of different configurations can be formed by assembly of the above components.

20 Claims, 5 Drawing Sheets

ARTICLE OF FURNITURE

This is a continuation of application Ser. No. 08/146,314, filed Nov. 2, 1992, now abandoned.

This invention relates to an article of furniture and, in particular, to a modular seating arrangement which is configurable to realise a number of desired seating configurations.

The invention is applicable, for example, in places where it is desired to have modular seating arrangements, such as in departure lounges at airports or waiting areas in professional offices, hospitals, halls and the like. A number of seating arrangements are known to be suitable for such applications, however they tend to suffer from a lack of flexibility in configuration and are difficult to assemble.

It is an object of the present invention to provide modular seating arrangement which can be assembled into various desired configurations with great flexibility and relative ease.

According to the present invention there is disclosed a modular seating arrangement configurable to realize any one of a number of desired seating configurations, said arrangement comprising, in combination, at least one spine of substantially uniform transverse cross-sectional shape and of predetermined length, at least a pair of supporting stands each of which has a rebated part of complementary shape to said cross-sectional shape of said spine and which receives said spine at spaced apart locations to support said spine, a plurality of seat frames or chairs each having a seat and a backrest, at least one elongate seat support for each said seat, each said seat frame support having one end thereof shaped to engage with said spine and the other end thereof being shaped to be connected to said seat, and at least one elongate backrest support for each backrest, each backrest support having one end thereof shaped to engage with said spine and the other end thereof being shaped to be connected to said seat, said seat support and said backrest support extending respectively forwardly and rearwardly of said spine when connected to said seat frame.

Preferably there are two seat frame supports at each side of a seat frame. A pair of seat frame supports on one side of a seat frame can also be fixed to an adjacent seat frame.

The arrangement can also comprise a further component being an arm rest, the arm rest having two ends each with means adapted to engage, and extend between, the said other ends of two seat frame supports on one side of a seat frame.

If desired, a spine can have an upstanding section at some intermediate point along its length. A side table can also be provided which has receiving means to engage an upstanding section, and preferably at an end of a spine.

Preferably a modular seating arrangement can be configured to include a right angled corner to allow an L-shaped configuration of a plurality of seat frames with a side table being located at the corner.

In order that the invention might be further explained, a preferred embodiment will now be described with reference to the accompanying drawings, in which.

FIGS. 6A–6D each illustrate in plan or perspective view one of a number of other seating configurations arranged at various angles with respect to side tables.

Figure 1:
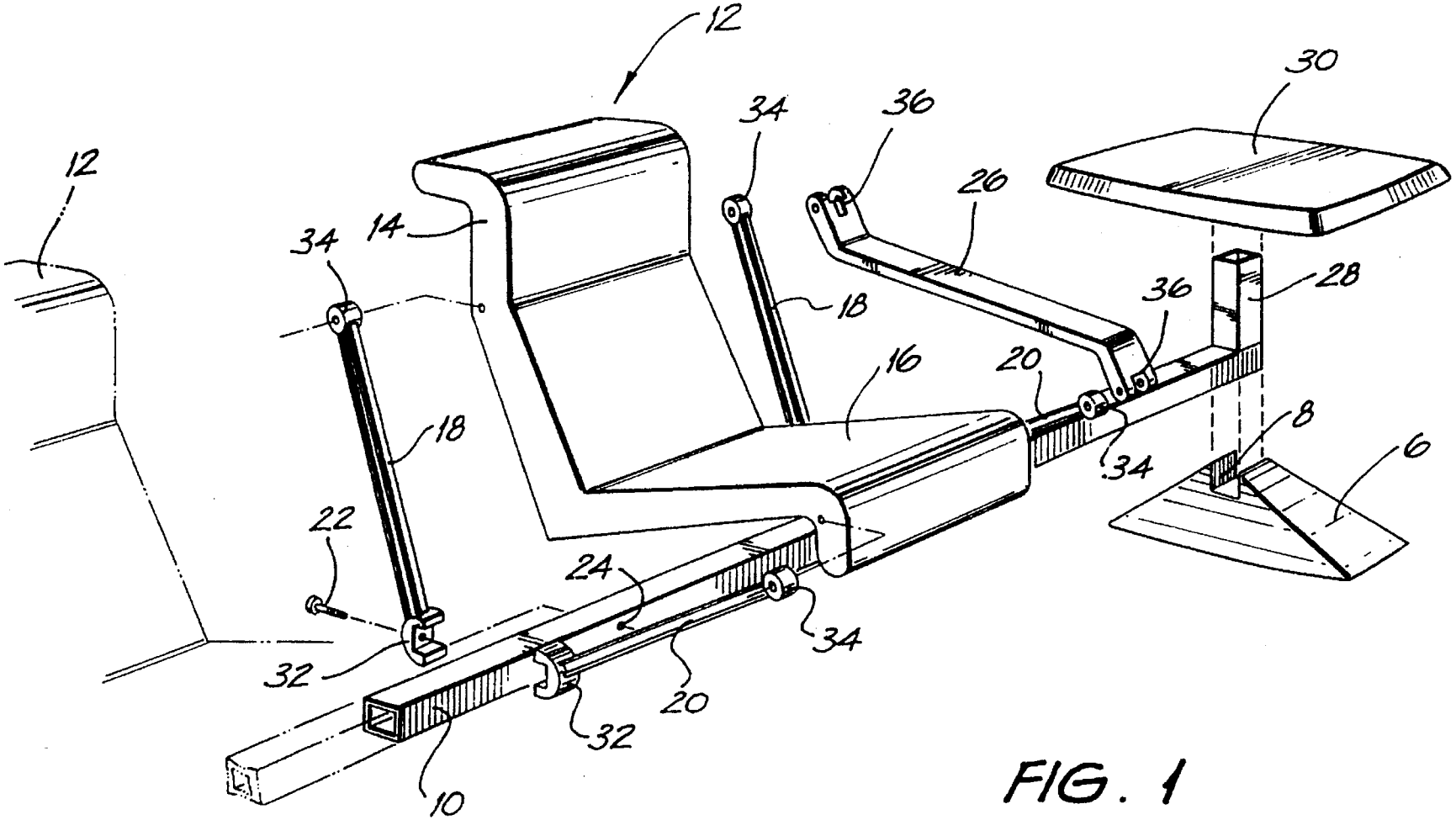
FIG 1 shows an exploded perspective view of a modular seating arrangement constructed in accordance with the preferred embodiment.

As seen in FIG. 1, the arrangement includes a number of basic modular seating components, There is a spine 10 which is of regular cross-section (rectangular in this embodiment) and which extends for a particular predetermined length. There is also a seat frame or chair 12 shaped in the form of a backrest 14 and a seat 16. The spine 10 is supported above the ground or a floor by at least two stands 6. The stands have a rebated section 8 which is of complementary shape to a part of the spine 10 so as to receive and hold the spine 10 in place. Whilst a minimum of two stands 6 is required in any arrangement, where there are a large number of seat frames 12, additional stands 6 are required to be spaced along the spine 10 to adequately support the load.

The seat frame 12 is generally moulded to conform to the shape of a person sitting thereupon. The seat frame 12 is mounted from the spine 10 by two frame supporting arms, namely a first arm 18 and a second arm 20 which are of slightly differing shape. The arms 18,20 each have at one end a rebated pan 32 which is complementarily shaped to a part of the spine 10. These ends 32 engage the spine 10, and are fixed to the spine by a locking screw management in the form of a screw 22 and which passes through screw hole 24 in one end 32 and role the other end 32. The other ends 34 of the arms 18,20 are respectively fixed to a point on the backrest 14 and at the front edge of the seat 16, thereby mounting the seat frame 12 from the spine 10 for use. This then constitutes a minimum or basic arrangement which can be replicated to realise any one of a number of desired arrangements.

Figure 2:
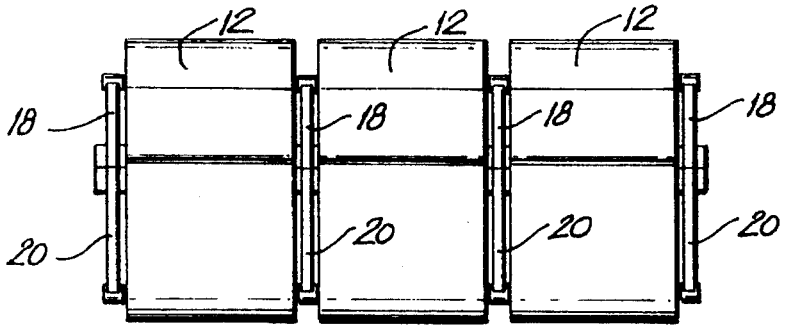
FIG. 2 shows another arrangement.

FIG. 2 shows an arrangement where three chair frames 12 are located side by side and supported by four sets of supporting arms 18,20 with all the supporting arms 18,20 other than those at the ends of a row supporting two adjacent seat frames 12.

FIG. 1 also shows an arm rest 26 which can, if desired, be incorporated in a desired arrangement. The ends 36 of the arm rest 26 each engage the respective ends 34 of the supporting arms 18,20 which fasten to the seat frame 12. FIG. 1 shows the mating configuration of the bifurcated ends 36 of the-arm rest. 26 with the ends 34 of the supporting arms 18,20. A pin or bolt (not shown) secures the arm rest 26, the respective arms 18,20 and the seat frame 12 in a common assembly and forms a truss which provides additional strength and rigidity.

Figure 3:
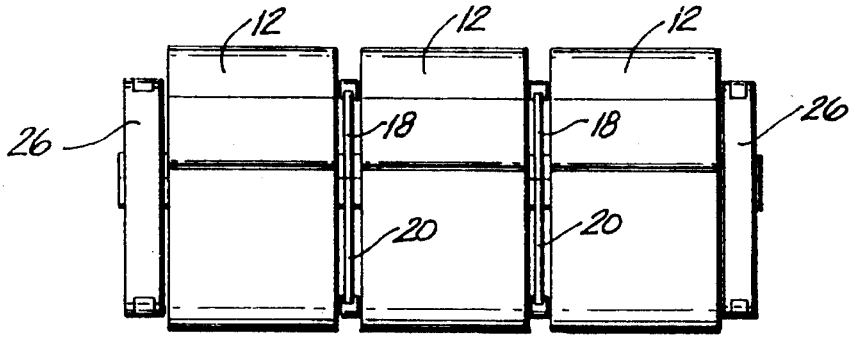
FIG. 3 shows yet a further arrangement.

FIG. 3 shows a configuration where an arm rest 26 has been incorporated only at each end of a row having three seats. It is equally possible to provide an arm rest 26 between each of the seat flames 12 given the flexibility of the system.

Figure 4:
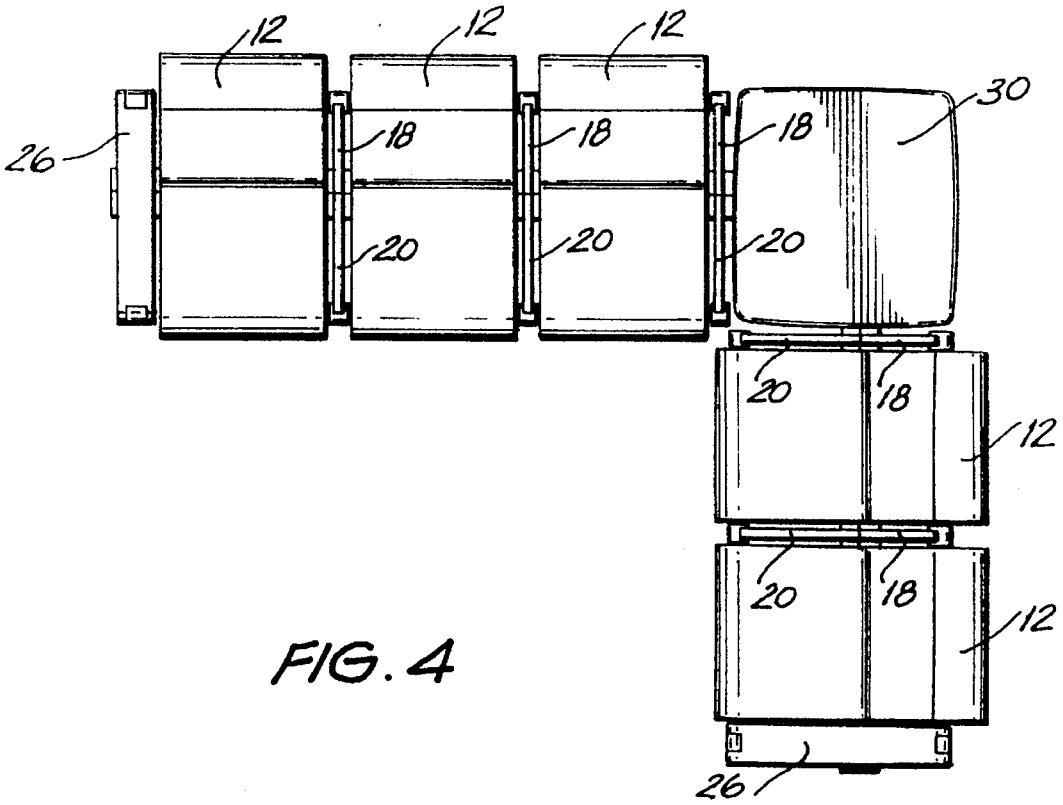
FIG. 4 shows a still further arrangement.
Figure 5:
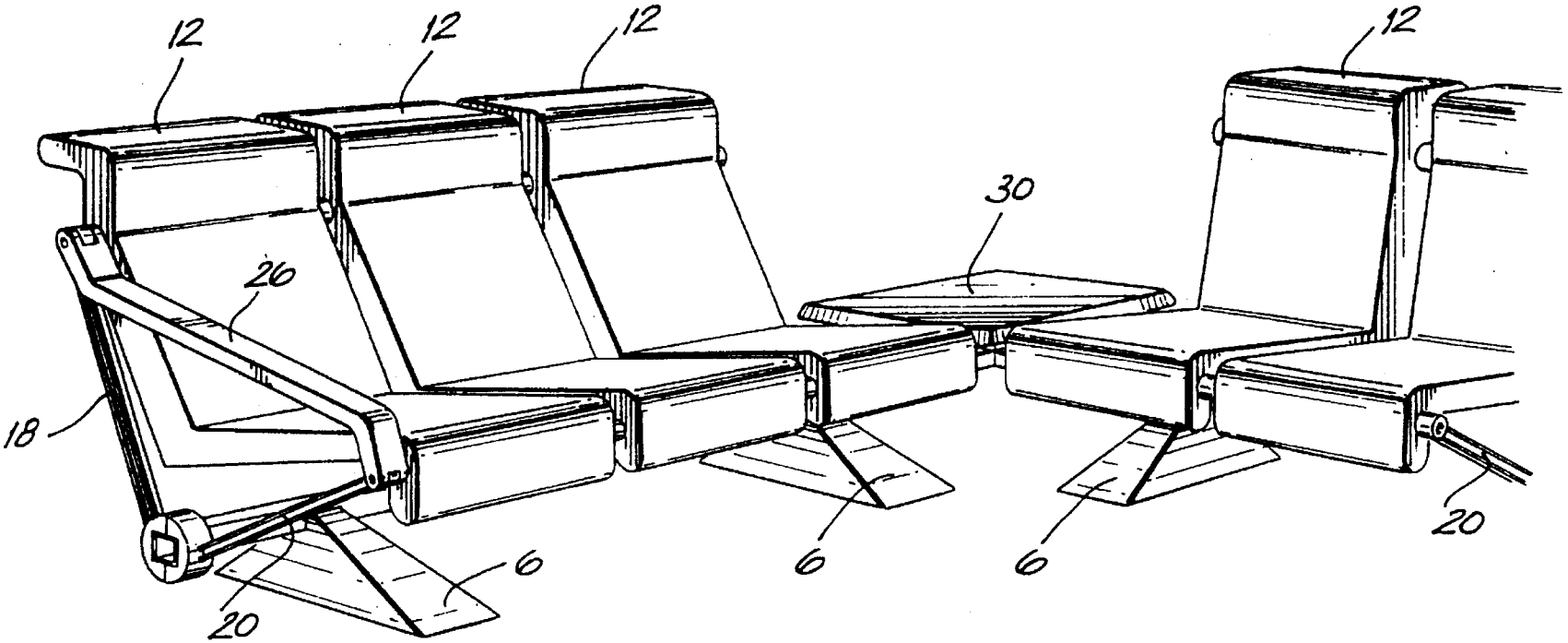
FIG. 5 shows a perspective view of part of the arrangement of FIG. 4.

FIG. 1 shows a further option available for realising a desired configuration, in that the spine 10 is provided with an upstanding portion 28, which receives a side table 30. The side table 30 has a corresponding mating recess (not illustrated) on the underside thereof to receive the upper end of the upstanding portion 28. A side table 30 can be provided at either end of a row of seat frames 12, between adjacent seat frames 12 or at the vertex of an L-shaped configuration as shown in FIG. 4. In FIG. 4 a second spine is arranged to engage the first spine 10. In this case the stand 6 shown in FIG. 1 is moved slightly to the left away from the upstanding section 28. In the alternative, a single spine can be manufactured W include the fight angle, although it is preferable to standardise on straight spine sections which can interengage at various angles to realise a desired configuration, since this reduces the volume of the arrangement in its knocked down form prior to assembly. FIG. 5 shows a view of the configuration of FIG. 4 in perspective. The locations of the arm rest 26 and the stands 6 can be clearly seen.

Figure 6A:
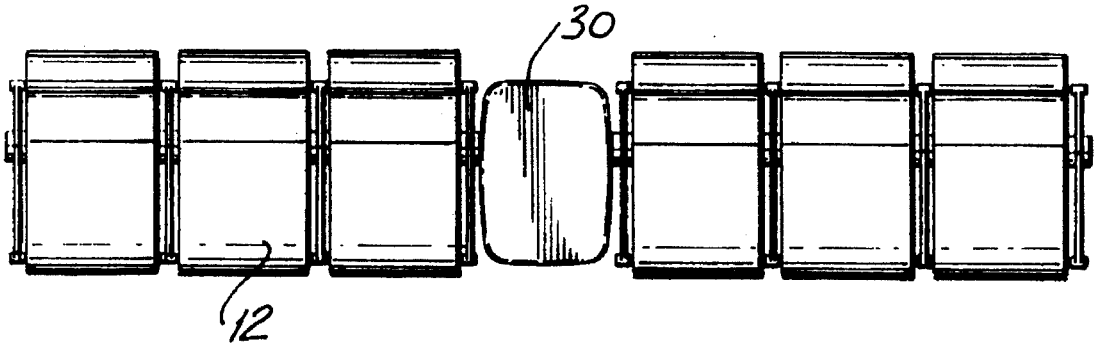

FIG. 6A shows two banks each of three seat frames 12 in a straight line interposed by a single side table 30. This arrangement is a form of variant to FIG. 4.

Figure 6B:
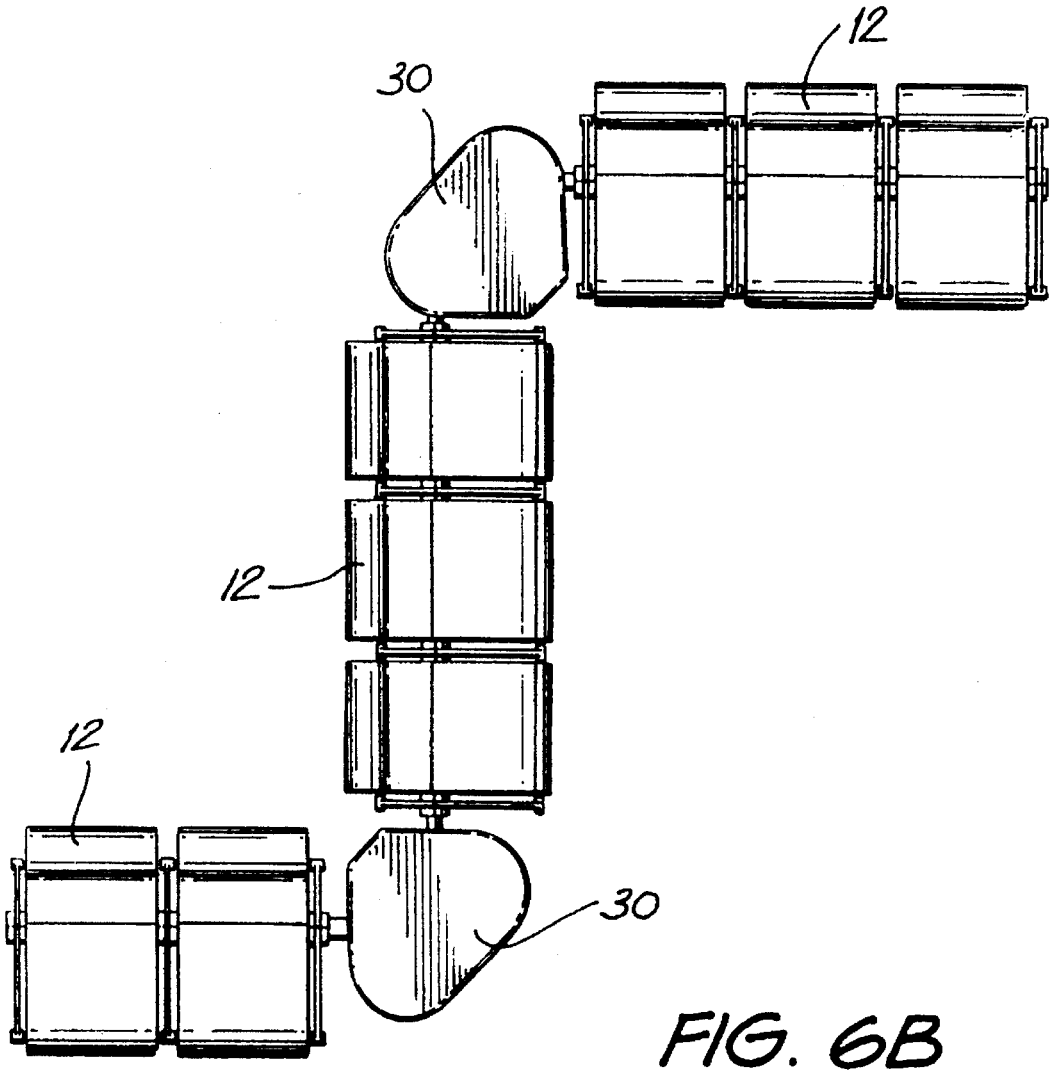

FIG. 6B is also a variant to FIG. 4, in that a second side table 30 has been included, as has an additional bank of three chair frames 12. In this instance the side table 30 has been styled or shaped away from being regularly sided.

Figure 6C:
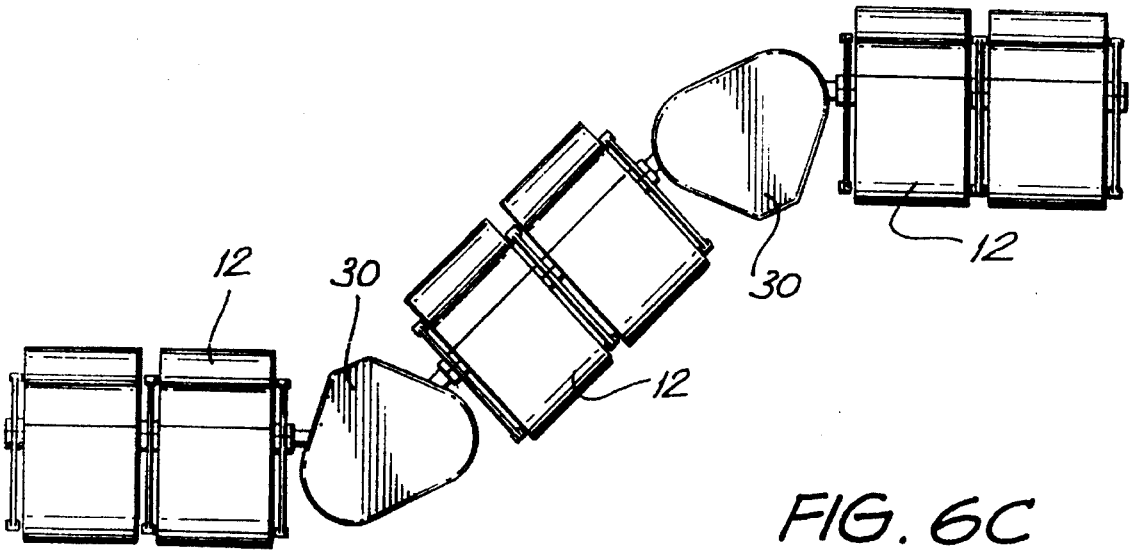
Figure 6D:
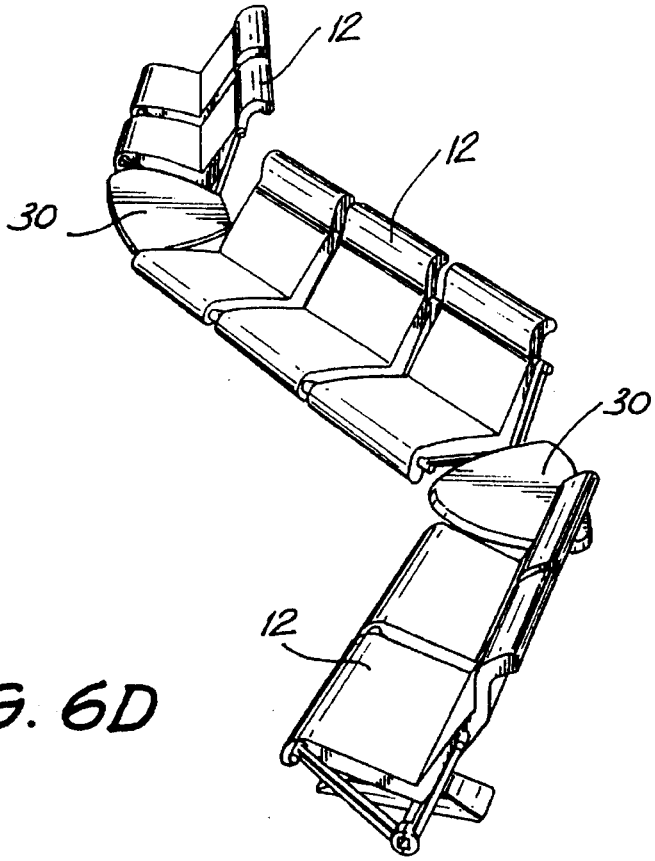

FIGS. 6C and 6D show that angular arrangements of banks of chair flames are possible other than the straight-line configuration of FIG. 6A or the right angled configuration of FIG. 6B. In this instance, the respective spines 10 are located in a rebated section 8 of a stand of the side table 30 at an obtuse angle with respect to each other. FIG. 6C is a plan view, whilst Fig, 6D is a perspective view of two slightly different configurations.

The arrangements of FIGS. 6A–6D again illustrate the flexibility of configuration of the modular seating components constructed in accordance with the present invention.

From the foregoing it will be appreciated that the invention discloses modular seating components which are readily and easily configurable to a desired arrangement. Once such a configuration is implemented there is no problem with subsequently reconfiguring the arrangement, or removing it to another location.

It will be appreciated by those skilled in the art that various modifications and alterations can be made and still fall within the broad inventive scope of the invention, examples of which have been described in the foregoing. For example, the first arm 18 and second arm 20 can be identical to save on the unit cost of manufacture. It is also possible that the arms 18,20 form a friction or snap fit onto the spine 10. In addition, if the seat frame 12 is sufficiently strong, the supporting arm 18 can be omitted and the seat frame 12 is then supported by the spine 10 and arm 20.

I claim:

1. A modular seating arrangement configurable to realize any one of a number of desired seating configurations, said arrangement comprising, in combination, at least one spine of substantially uniform transverse cross-sectional shape and of predetermined length, at least a pair of supporting stands each of which has a rebated part of complementary shape to said cross-sectional shape of said at least one spine and which receives said at least one spine at spaced apart locations to support said at least one spine, a plurality of seat frames each having a seat and a backrest formed as a unitary structure, at least one elongate seat support for each said seat, each said seat support having one end thereof shaped to engage with said at least one spine and the other end thereof shaped to be connected to an extremity of said seat distal from said at least one spine, and at least one elongate backrest support for each said backrest, each said backrest support having one end thereof shaped to engage with said at least one spine and the other end thereof shaped to be connected to an extremity of said backrest distal from said at least one spine, said seat support and said backrest support being separable and extending respectively forwardly and rearwardly of said at least one spine when connected to said at least one spine and said seat frame.

2. An arrangement as claimed in claim 1 wherein a single seat support and a single backrest support constitute a support pair, there being one more support pair than the number of seat frames with a support pair being located alongside each side of each said seat frame.

3. An arrangement as claimed in claim 1 and further comprising an elongate arm rest having two extremities, one extremity of said arm rest being connected to the other end of said seat support and the other extremity of said arm rest being connected to the other end of said backrest support.

4. An arrangement as claimed in claim 1 wherein said at least one spine has an upstanding portion engageable with the underside of a table to thereby support said table.

5. An arrangement as claimed in claim 4 wherein said upstanding portion and table are located adjacent one end of said at least one spine to position said table at the end of a row of said seat frames.

6. An arrangement as claimed in claim 4 wherein said upstanding portion and table are located at the intersection of two spines to position said table between two rows of said seats.

7. An arrangement as claimed in claim 6 comprising a first plurality of tables and a second plurality of spines, said second plurality being greater by one than said first plurality.

8. A modular seating arrangement configurable to realize a desired seating configuration, said arrangement comprising, in combination, a spine of substantially uniform transverse cross-sectional shape and of predetermined length, at least a pair of supporting stands each of which has a rebated part of complementary shape to said cross-sectional shape of said spine and which receives said spine at spaced apart locations to support said spine, a plurality of seat frames each having a seat and a backrest formed as a unitary structure, each of said seat frames being supported from said spine separately by an elongate seat support extending from said spine to connect with said seat at an extremity of said seat distal from said spine and an elongate backrest support extending from said spine to connect with said backrest at an extremity of said backrest distal from said spine, said seat support and said elongate backrest support forming separate parts of a support pair, and there being a support pair located alongside each side of each said seat frame, each said seat support having one end thereof shaped to engage with said spine and extending forwardly of said spine and the other end thereof being shaped to be connected to said seat, and each said backrest support having one end thereof shaped to engage with said spine and extending rearwardly of said spine and the other end thereof being shaped to be connected to said backrest.

9. A modular seating arrangement, comprising:

a spine having a substantially uniform cross-sectional shape;

a spine supporting means for supporting said spine relative to a floor surface;

a chair having a seat and a backrest formed as a unitary structure;

a first rigid support extending from said spine to said seat;

a first connecting means for connecting said first rigid support to said spine;

a second connecting means for connecting said first rigid support to said seat;

a second rigid support extending from said spine to said backrest;

a third connecting means for connecting said second rigid support to said spine, wherein said first connecting means and said third connecting means cooperate to releasably secure said first rigid support relative to said second rigid support; and a fourth connecting means for connecting said second rigid support to said backrest.

10. A modular seating arrangement according to claim 9, wherein said spine extends between a first end and a second end, and said spine supporting means includes a first stand that supports said first end, and a second stand that supports said second end in such a manner that said spine extends substantially parallel to the floor surface.

11. A modular seating arrangement according to claim 9, wherein said chair faces in a forward direction, and said first rigid support extends forward and upward from said spine to said seat.

12. A modular seating arrangement according to claim 9, wherein said chair faces in a forward direction, and said second rigid support extends linearly rearward and upward from said spine to said backrest.

13. A modular seating arrangement according to claim 9, wherein said first connecting means includes an end of said first rigid support that is configured to engage said spine, and said third connecting means includes an end of said second rigid support that is configured to engage said spine, and said ends of said first and second rigid supports are releasably secured adjacent one another to capture said spine therebetween.

14. A modular seating arrangement according to claim 13, wherein a screw secures said ends of said first and second rigid supports relative to said spine.

15. A modular seating arrangement according to claim 9, wherein said second connecting means includes an end of said first rigid support that occupies a position adjacent said seat, and a bolt that extends through said end and said seat.

16. A modular seating arrangement according to claim 9, wherein said fourth connecting means includes an end of said second rigid support that occupies a position adjacent said backrest, and a bolt that extends through said end and said backrest.

17. A modular seating arrangement according to claim 9, further comprising a third rigid support identical to said first rigid support and disposed on an opposite side of said chair, and a fourth rigid support identical to said second rigid support and disposed on an opposite side of said chair.

18. A modular seating arrangement according to claim 17, wherein said second connecting means includes a first bolt extending through said first rigid support, said seat, and said third rigid support, and said fourth connecting means includes a second bolt extending through said second rigid support, said backrest, and said fourth rigid support.

19. A modular seating arrangement according to claim 9, wherein said chair faces in a forward direction, and said first and second rigid supports are releasably secured relative to said spine and one another in such a manner that said first rigid support extends forward and upward from said spine to said seat, and said second rigid support extends rearward and upward from said spine to said backrest.

20. A modular seating arrangement according to claim 9, wherein said second connecting means includes an end of said first rigid support that occupies a position adjacent said seat, and said fourth connecting means includes an end of said second rigid support that occupies a position adjacent said backrest, and an armrest extends between said ends of said first and second rigid supports.

* * * * *